US005087397A

United States Patent [19]

Martinez

[11] Patent Number: 5,087,397

[45] Date of Patent: Feb. 11, 1992

[54] PROCESS FOR FORMING ARCUATE SHEET ROCK PANELS

[76] Inventor: Johnny T. Martinez, 815 Maryland Ct., Cheyenne, Wyo. 82009

[21] Appl. No.: 696,082

[22] Filed: May 6, 1991

[51] Int. Cl.[5] ..... B28B 11/00; E04B 1/32; E04G 23/00

[52] U.S. Cl. ..... 264/32; 52/85; 52/86; 52/745; 264/86; 264/87; 264/322; 264/343; 264/DIG. 66

[58] Field of Search ..... 264/322, 32, 86, 87, 264/232, 233, 340, 343, DIG. 66, 295, 294, 35, 82; 52/85, 86, 745, 746

[56] References Cited

U.S. PATENT DOCUMENTS

| | | | |
|---|---|---|---|
| 1,337,254 | 4/1920 | Muench | 264/DIG. 66 X |
| 2,016,568 | 10/1935 | Zinser | 264/322 X |
| 2,338,685 | 1/1944 | Dee | 264/DIG. 66 |
| 2,517,701 | 8/1950 | Oettinger, Jr. | 264/571 |
| 3,615,966 | 10/1971 | Ljungbo | 264/343 X |
| 3,675,692 | 7/1972 | Jeans | 264/322 X |
| 3,894,569 | 7/1975 | Huttunen | 264/343 X |
| 3,911,554 | 10/1975 | Ford . | |
| 4,069,640 | 1/1978 | Dawdy | 52/746 |
| 4,092,992 | 6/1978 | Huddle | 52/745 X |
| 4,400,917 | 8/1983 | Massaro et al. | 52/86 |
| 4,873,047 | 10/1989 | Jenkins et al. | 264/322 |

*Primary Examiner*—Jan H. Silbaugh
*Assistant Examiner*—Karen Aftergut

[57] ABSTRACT

A process of forming a curved sheet rock panel that can later be used in curved ceiling constructions within buildings. Initially a flat sheet rock panel is soaked with water, and then squeezed to remove excess water. The pliable panel is transferred to an arcuate form, where it quickly remolds itself to the arcuate surface contour on the form. The arcuate panel is dried to a stiff, but still pliable, condition in which it can be fastened to an arcuate ceiling framework.

5 Claims, 1 Drawing Sheet

PROCESS FOR FORMING ARCUATE SHEET ROCK PANELS

BACKGROUND AND SUMMARY OF THE INVENTION

This invention relates to a process for forming curved ceilings in buildings.

In homes, apartment buildings, hotels and commercial buildings (e.g. shopping malls) it is sometimes desired to have arched (curved) ceilings. Such curved ceilings can be arcuate semi-cylindrical ceiling sections extending above the flat plane of the normal horizontal ceilings, to thereby form a raised cathedral ceiling section; the arcuate ceiling often has an arcuate length of about one hundred eighty degrees.

The raised curved ceiling section can provide an ornamental accent to an otherwise plain ceiling. The raised curved ceiling section can also be used as an ornamental ceiling for a hallway or as an ornamental relief to a large ceiling area; the arcuate ceiling section can be used to interrupt large flat ceiling sections, to thus avoid a monotonous or dull appearance that a large flat ceiling can sometimes present.

Arcuate ceiling sections can also be used to form cove ceilings. A cove ceiling comprises the usual flat horizontal central ceiling section except that is curved downwardly at its peripheral edges, where it joins the room walls. Each arcuate curved section has an arc of ninety degrees, to provide a rounded transition from the horizontal ceiling to the vertical walls.

Ceilings are often formed of flat sheet rock panels that comprise crystalline gypsum rock material sandwiched between facing sheets of treated paper. It is difficult to bend such panels into curved shapes because the crystalline gypsum tends to crack and fracture; the weight of the gypsum causes the treated paper sheets to tear along the fracture points, thereby interrupting the smooth panel surface.

The present invention concerns a process for forming sheet rock panels into curved arcuate configurations so that such panels can be used to form curved ceiling sections. The process involves thoroughly saturating a sheet rock panel with water, placing the wet panel on an arcuate form so that the panel conforms to the arcuate contour of the form, and allowing the curved panel to partially dry on the form. When the panel has dried to a relatively stiff condition it is removed from the form and nailed or otherwise fastened to a curved ceiling framework.

THE DRAWINGS

DESCRIPTION OF A PREFERRED EMBODIMENT OF THE INVENTION

Figure 1:
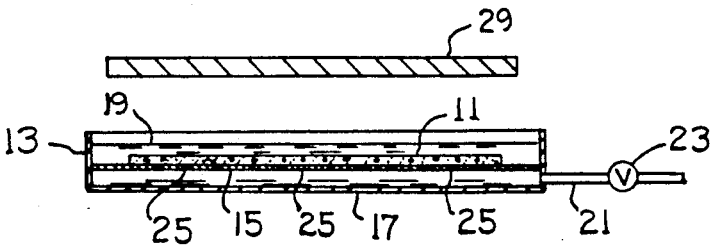
FIG. 1 shows an apparatus that can be used to soak a sheet rock panel in the practice of the present invention.

FIG. 1 shows an apparatus for soaking a conventional sheet rock panel 11. The apparatus comprises a shallow tray 13 having a false bottom wall 15 for supporting the sheet rock panel above the true bottom wall 17. The panel is soaked with water by pouring water into the tray. Numeral 19 illustrates the water level after the panel has become immersed in the water.

Excess water is removed from the panel by draining the water out of the tray. A drain line 21 contains a valve 23. When the valve is opened the water is drained out of the tray. Perforations 25 spaced along wall 15 facilitate the process of draining excess water out of the voids in panel 11.

The draining process is continued for a prolonged period of time, at least about one half hour. An aim of the draining process is to achieve a pliable panel condition without unduly decreasing the panel strength. If the water content is too high the treated paper will tear under the weight of the gypsum core lamination. If the water content is too low the panel will lose its pliability, i.e. its ability to be reformed into a curved (arcuate) shape.

The draining process may be somewhat shortened timewise by placing a heavy weight on the panel upper surface. FIG. 1 shows a relatively heavy plate 29 located above panel 11. The plate can be lowered onto the surface of panel 11 to exert a downward squeezing force on the panel. This accelerates the drainage of water from the panel through perforations 25. The water drainage action could also be accelerated by applying a vacuum on line 21.

Figure 2:
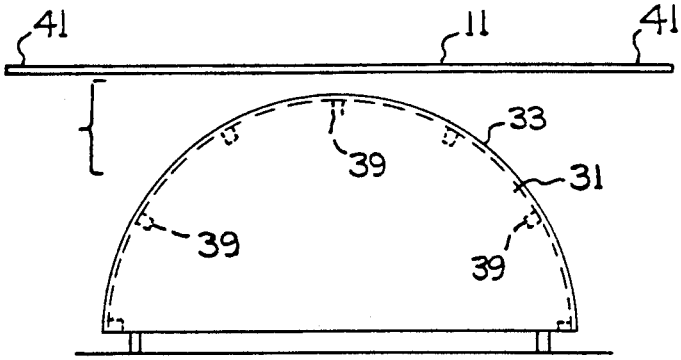
FIG. 2 is an end elevational view of an arcuate form that can be used in practice of the invention.
Figure 3:
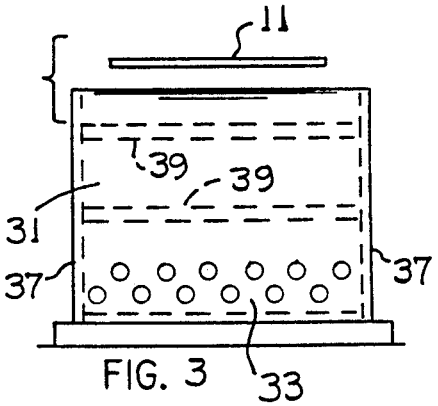
FIG. 3 is a side elevational view of the arcuate form shown in FIG. 2.

The water drainage action is allowed to continue until there is no discernible flow of water through line 21; at least about one half hour is usually required. The still-wet panel is placed on an arcuate form to reform it into an arcuate configuration. FIG. 2 shows an arcuate form 31 that includes a thin curved sheet 33 and two arcuate segmental end walls 37. Reinforcement bars 39 extend between end walls 37 to maintain the curvature of sheet 33 under the weight of panel 11. Arcuate form 31 can be made of different materials or combinations of materials, e.g. wood, plywood, metal, plastic, etc. Sheet 33 preferably has openings therealong to promote an accelerated drying action of panel 11. Some openings are shown in FIG. 3.

Figure 4:
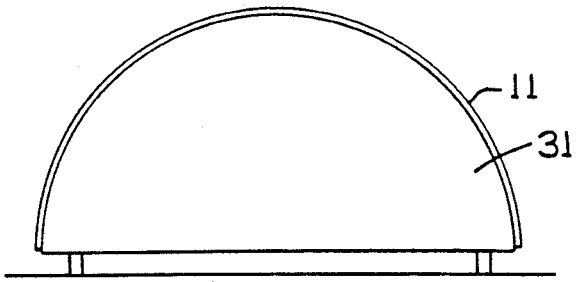
FIG. 4 is taken in the same direction as FIG. 2, but with a sheet rock panel placed on the form.

FIG. 2 shows a pliable sheet rock panel 11 located above form 31. The panel can be lowered onto the curved surface of form 31 to mold the panel into an arcuate configuration. The panel is preferably transferred from tray 13 (FIG. 1) directly onto arcuate form 31 in one continuous lifting and lowering motion; two workpersons are required. The workpersons stand at opposite ends of panel 11 and grasp edge areas 41 of the panel; the panel is lifted out of tray 13 and onto the arcuate form 31 in one continuous sweeping motion. The pliability of the panel is such that when the panel is lowered onto form 31 it quickly conforms to the arcuate surface contour of the form. FIG. 4 shows the panel remolded into an arcuate configuration on form 31.

The arcuate panel 11 is partially dried by allowing it to remain on arcuate form 31 for approximately one half hour. If heated air were to be blown over the panel the drying action could be somewhat accelerated. During the drying period the panel becomes partially dried into a stiff condition. However, the panel is not fully dried; moisture within the panel gives it some pliability. This pliability is advantageous when the panel is being fastened to an arcuate ceiling framework, as the panel can then flex slightly to adjust to variances in the framework contours (without cracking).

Figure 5:
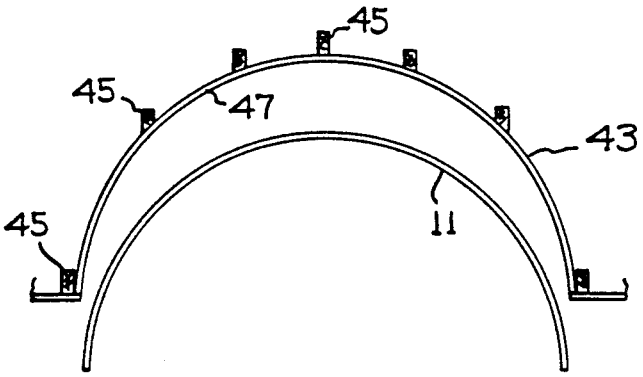
FIG. 5 is a view showing a curved sheet rock panel as it is being installed on a curved ceiling framework.

FIG. 5 shows the stiffened panel being raised into a position where it can be fastened to an arcuate framework 43. The framework can be comprised of a series of horizontal beams 45 extending normal to the plane of the paper, and a series of curved batten strips 47 extending transversely across the beams (parallel to the plane of the paper). The curved panel 11 will be nailed or stapled to strips 47 along its curved longitudinal edges. The nail spacing (or staple spacing) will be relatively small, e.g. about six or eight inch, to adequately support the panel 11 weight.

A typical arched ceiling will be relatively long, e.g. twelve or more feet. To construct such a ceiling several curved panels 11 will be required. The panels will be arranged with their curved longitudinal edges abutted together against the surfaces of batten strips 47. An assembly of such curved panels will form an elongated arched ceiling.

As previously noted, the curved panels 11 can also be used in the construction of cove ceilings. In that case the panel curvature would have an arcuate length of only ninety degrees, rather than the one hundred eighty degree arc length shown in the drawings.

What is claimed is:

1. A process of forming an arched ceiling with a sheet rock panel, comprising the steps of thoroughly soaking a sheet rock panel with water, removing free-flowing water from the sheet rock panel by allowing it to lie flat so that the free-flowing water drains from interior void spaces of the panel, placing the still-wet panel on an arcuate form whereby the panel is reconfigured to an arcuate configuration, partially drying the reconfigured panel by allowing it to remain on the arcuate form for a sufficient time so that it is still pliable but stiff enough to handle without losing its arcuate configuration, and fastening the partially dried, reconfigured panel to an arcuate ceiling framework.

2. The process of claim 1, wherein the step of removing free-flowing water from the panel comprises leaving the panel in a flat prone state for at least one half hour.

3. The process of claim 2, wherein the step of partially drying the reconfigured panel comprises leaving the panel on the arcuate form for approximately one half hour.

4. The process of claim 1, wherein the step of removing free-flowing water from the panel comprises leaving the panel in a flat prone state for at least one half hour while applying a downward force on an upper surface of the panel.

5. The process of claim 4, wherein the downward force is achieved by laying a flat weighted plate on the upper surface of the panel.

* * * * *